United States Patent [19]

Guha

[11] Patent Number: 4,657,601

[45] Date of Patent: Apr. 14, 1987

[54] THERMOMECHANICAL PROCESSING OF BERYLLIUM-COPPER ALLOYS

[75] Inventor: Amitava Guha, Cleveland Heights, Ohio

[73] Assignee: Brush Wellman Inc., Cleveland, Ohio

[21] Appl. No.: 763,709

[22] Filed: Aug. 8, 1985

Related U.S. Application Data

[63] Continuation-in-part of Ser. No. 550,631, Nov. 10, 1983, abandoned.

[51] Int. Cl.[4] ..... C22F 1/08

[52] U.S. Cl. ..... 148/12.7 C; 148/414; 148/435; 420/485

[58] Field of Search ..... 148/12.7 C, 11.5 C, 148/414, 13.2, 435; 420/485

[56] References Cited

U.S. PATENT DOCUMENTS 2,257,708 9/1941 Stott ..... 148/12.7 C 4,425,168 1/1984 Goldstein et al. ..... 148/12.7 C

FOREIGN PATENT DOCUMENTS 0163248 12/1981 Japan ..... 148/414

*Primary Examiner*—Melvyn J. Andrews

*Assistant Examiner*—S. Kastler

*Attorney, Agent, or Firm*—Ewan C. MacQueen; Eugene J. Kalil

[57] ABSTRACT

The invention contemplates a thermomechanical process applicable to beryllium copper alloys consisting essentially of about 0.2 wt % to about 0.7 wt % beryllium; from about 1.0 wt % to about 3.5 wt % nickel and cobalt in the aggregate, where nickel comprises at least about 1.0 wt %; up to about 1.0 wt % zirconium; up to about 0.005 wt % lead; up to about 0.1 wt % magnesium; up to about 1.5 wt % silver; up to about 0.5 wt % incidental impurities including lead; and the balance essentially copper; which process comprises solution annealing said alloy at a temperature of at least about 90% of the incipient melting point of the alloy expressed in degrees Fahrenheit, cold working the solution treated alloy to reduce the section thickness thereof at least about 60% or much more, and then aging the alloy to produce therein an improved combination of properties including strength, ductility, formability and conductivity.

14 Claims, 3 Drawing Figures

THERMOMECHANICAL PROCESSING OF BERYLLIUM-COPPER ALLOYS

This application is a continuation in part of U.S. Ser. No. 550,631 filed Nov. 10, 1983 now abandoned. The present invention is directed to a thermomechanical process for improving the mechanical properties of beryllium-copper alloys and to the product resulting therefrom.

BACKGROUND OF THE INVENTION AND THE PRIOR ART

Beryllium-copper alloys having a variety of compositions and presenting a range of properties, both mechanical and electrical, are known. Such alloys may contain beryllium in the range of about 0.1% to about 3% to confer age hardenability through a precipitation hardening heat treatment and may contain small amounts of other alloying ingredients such as cobalt, nickel, silver, etc. for special purposes. The alloys in strip form are useful for the production of connectors, switch parts, relays and many other parts amenable to production in progressive dies. In rod, bar, tube and plate form the alloys find use in machined connectors, welding electrodes, injection molding tooling and similar applications. As uses of the alloys have progressed, a demand has arisen for stronger alloys which would still retain significant ductility, electrical conductivity, formability and other desirable properties. For example, the strength of the alloys can be increased by application of cold work in amounts up to possibly 37%, e.g., 21%, after precipitation hardening, but such a practice reduces the ductility and formability of the material and, in addition, electrical conductivity is also degraded. On the other hand, increases in conductivity may be achieved by substantial overaging, but at the expense of strength.

Heat treatment of the alloys usually involves a solution annealing treatment to insure solid solution of the alloying elements added for strengthening, and a precipitation-hardening (aging) heat treatment. Solution annealing of the alloys is conducted commercially at a temperature in the range of about 1325° F. to about 1650° F. for short periods, e.g., about 5 minutes. A quench, e.g., a water quench, is employed after solution treating to retain alloying elements in solution. Aging is usually conducted in the temperature range of about 450° F. to about 925° F. for periods of up to about 4 hours.

The invention is directed to a thermomechanical process for providing, in certain beryllium-copper alloys, improved strength, ductility and formability as compared to the properties attainable by prior procedures, without degradation of conductivity.

SUMMARY OF THE INVENTION

Beryllium-copper alloys consisting essentially of about 0.2 wt% to about 0.7 wt% beryllium; from about 1.0 wt% to about 3.5 wt% nickel and cobalt in the aggregate, where nickel comprises at least about 1.0 wt%; up to about 1.0 wt% zirconium; up to about 0.005 wt% lead; up to about 0.1 wt% magnesium; up to about 1.5 wt% silver; up to about 0.5 wt% incidental impurities including lead; and the balance essentially copper; are processed by solution annealing at a temperature at least 90% of the incipient melting temperature of the alloy sufficient to form a previously unreported fine dispersion of nickel-rich precipitate phase, cold working the solution annealed alloy to effect a reduction in excess of about 60%, and thereafter aging the cold-worked alloy to impart thereto an improved combination of mechanical properties including strength and ductility, formability and electrical conductivity.

DESCRIPTION OF THE DRAWING

The drawing shown in FIG. 1 depicts the optical microstructure, taken at 1000 diameters in the longitudinal orientation, of a strip product provided in accordance with the invention. Transmission electron micrographs are also shown in FIGS. 2(*a*) and 2(*b*) at 18,000X and 141,000X respectively, showing the nickel-rich precipitates, identified as A, and the principal hardening phases, identified as B, consisting of Guinier-Preston zones and $\gamma''$ precipitates.

DETAILED DESCRIPTION OF THE INVENTION

Alloy products provided in accordance with the invention contain, in addition to copper, beryllium and nickel as essential ingredients with beryllium being in the range, of about 0.2 wt% to about 0.7 wt%, preferably about 0.4 wt% to about 0.7 wt% and nickel being in the range of about 1.0 wt% to about 3.5 wt%, preferably about 1.4 wt% or 1.6 wt% or 1.8 wt% to about 2.2 wt% to as much as about 3.5 wt%. Alternatively, nickel and cobalt may be present in combination in the range of about 1.0 wt% to about 3.5 wt%, where nickel constitutes at least about 1.0 wt%. Other incidental elements and impurities may be present in a total amount of about 0.5 wt% maximum. Such elements and impurities may include silicon, iron, aluminum, tin, zinc, chromium, lead, phosphorus, sulfur, etc. They should not generally be present in amounts exceeding 0.1% each, more preferably in amounts less than 0.01% each, or even lower, as these elements are detrimental to electrical conductivity or mechanical properties. However, these alloys may contain up to about 1.0 wt% zirconium, up to about 0.1 wt% magnesium and up to about 1.5 wt% silver for enhancement of thermal and electrical conductivity or improvement of elevated temperature strength/ductility behavior.

Conveniently, solution annealing is performed when the material is at a ready-to-finish gage. Solution annealing time is only that required to thoroughly heat through the section being treated. A rapid quench from the annealing temperature, e.g., an atmosphere or a water quench, is employed.

Alloys treated in accordance with the invention usually will have an incipient melting point (measured in degrees F.) of at least about 1900° F. In carrying out the invention, the solution annealing is conducted at a temperature of at least about 90% of the incipient melting point for the alloy (measured in degrees F.) to effect the precipitation of a fine dispersion of a nickel-rich phase. Advantageously, solution annealing is conducted at 92%, or even at 95% of the incipient melting point of the alloy measured in degrees F. Incipient melting, however, should be avoided. The solution-annealed alloy is then cold-worked to effect a high reduction in excess of about 60%, e.g., about 75%, or 80%, or 90% or more, without an intermediate anneal. The highly cold-worked material, usually in strip form, is then aged usually in the temperature range of about 600° F. to about 900° F. for up to 4 hours, e.g., about 2 to about 8 hours. Optimum aging times and temperatures within these ranges are dictated by composition and the property levels desired in the product.

Figure 1:
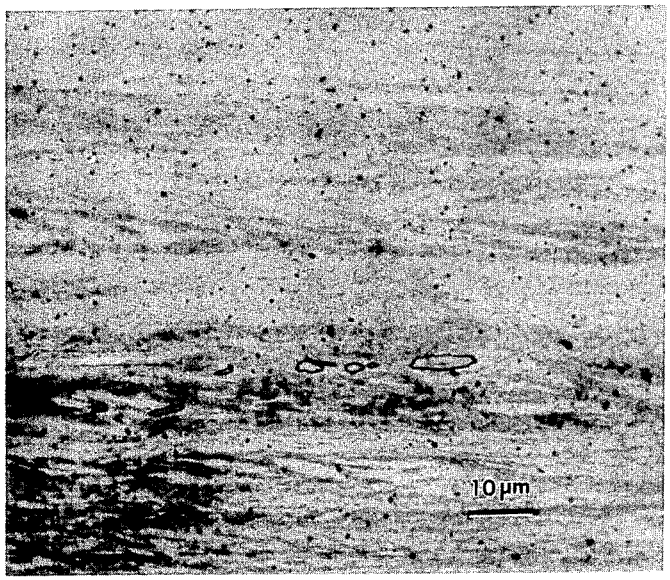
Figure 2A:
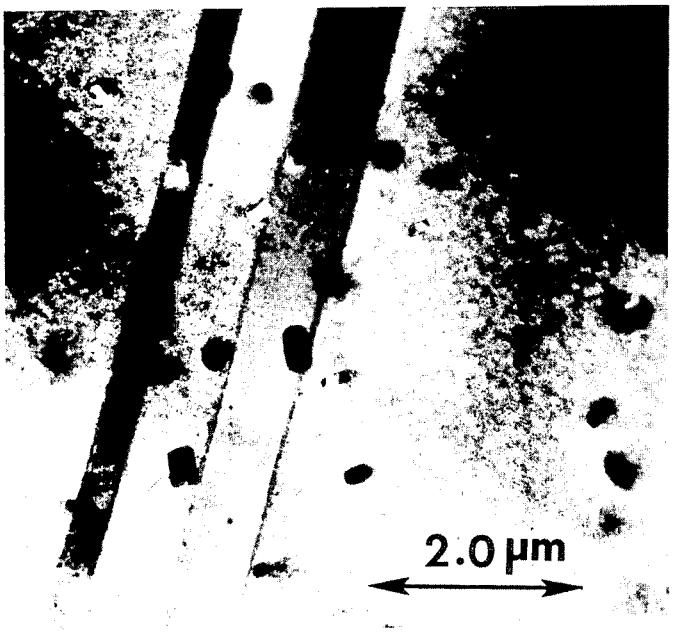
Figure 2B:
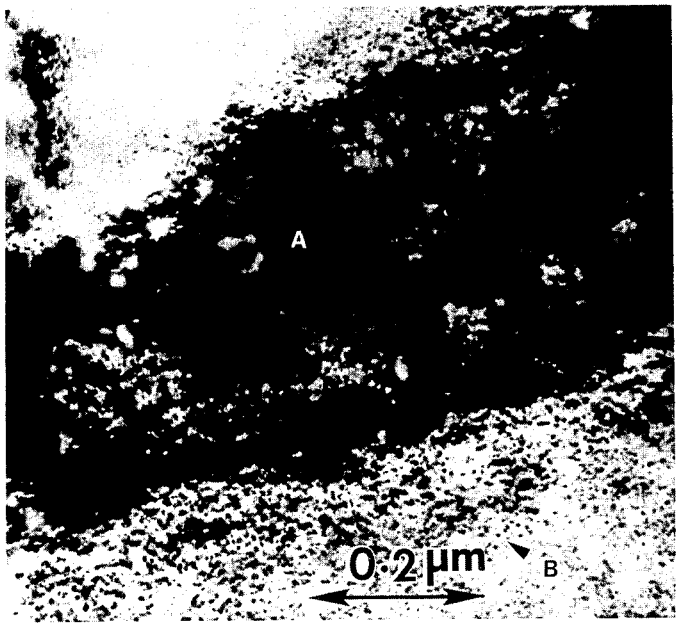

The solution annealed material is characterized by a fine dispersion of nickel-rich precipitates which raise as-annealed hardness and contribute to inhibition of grain growth. The cold worked solution annealed material is characterized by a texture or preferred grain orientation which results in obtaining a yield strength which is higher in the transverse direction than in the longitudinal direction. The textured grain orientation in the heavily cold worked alloy product of the invention is evident in the drawing (FIG. 1), as is the precipitation of a nickel-rich phase appearing in random distribution as dark spots in FIG. 1 and as discrete particles (identified as A) in the size range 0.13–0.25 micron in FIG. 2(*a*) and FIG. 2(*b*). The principal hardening phases are much more difficult to resolve in the optical microscope but can be detected using techniques such as transmission electron microscopy as shown in FIG. 2(*a*) and FIG. 2(*b*). They (identified as B in FIG. 2(*a*) and FIG. 2(*b*)) consist of Guinier-Preston zones and $\gamma''$, as finely dispersed particles 50 to 100 Å in diameter. The copper-base material from which the drawing was taken was 0.008 inch thick strip of an alloy which contained 0.42 wt% Be and 1.70 wt% Ni, which had been solution annealed at 0.080 inch thickness at a temperature of 1800° F., had been cold worked 90% and aged 4 hours at 750° F.

In order to illustrate the advantages of the invention, the following examples are given:

EXAMPLE 1

A notable feature of the invention is that the annealed hardness increases in an unexpected manner above the solution annealing temperature at which the nickel-rich precipitate particles form. To illustrate the anomalous hardening of the alloys containing nickel in amounts greater than about 1.0 wt%, strip samples of varying compositions were quenched after holding 1 hour at the solution annealing temperatures of 1650° F. and 1800° F. Hardness and microstructural observations were made in the as-quenched condition. The results are set forth in Table 1 and Table 2.

TABLE 1

As-quenched Hardness of Beryllium Copper Alloys Solution Annealed at 1650 F. and 1800 F. (1 Hour at Temperature) (Compositions in wt %)

| Solution Annealing Temperature | As-quenched Hardness, DPH | | | |
|---|---|---|---|---|
| | Heat A (0.43 Be, 1.71 Ni, 0.03 Co, bal. Cu) | Heat B (0.36 Be, 1.52 Ni, 0.15 Co, bal. Cu) | Heat C (0.63 Be, 2.50 Co, 0.01 Ni, bal. Cu) | Heat D (0.58 Be, 2.62 Co, 0.01 Ni, bal. Cu) |
| 1650 F. | 70 | 65 | 79 | 91 |
| 1800 F. | 84 | 74 | 80 | 80 |

TABLE 2

Results of Metallographic Observation on the Formation of a Fine Nickel-rich Precipitate Phase in Beryllium Copper Alloys during Solution Annealing at 1650 F. and 1800 F. (Compositions in wt %)

| Solution Annealing Temperature | Heat A (0.43 Be, 1.71 Ni, 0.03 Co, bal. Cu) | Heat B (0.36 Be, 1.52 Ni, 0.15 Co, bal. Cu) | Heat C (0.63 Be, 2.50 Co, 0.01 Ni, bal. Cu) | Heat D (0.58 Be, 2.62 Co, 0.01 Ni, bal. Cu) | Heat E (0.5 Be, 1.00 Co, 1.00 Ni, bal. Cu) |
|---|---|---|---|---|---|
| 1650 F. | B | B | B | B | B |
| 1800 F. | A | A | B | B | A |

A = Nickel-rich precipitate observed.
B = Nickel-rich precipitate not observed.

EXAMPLE 2

Several heats were prepared having the compositions (wt%) set forth in Table 3.

The commercial weight ingot material from Heat F was hot rolled to 0.8 inch plate. Four pieces of 0.8 inch plate from Heat F were solution annealed respectively at 1750° F., 1800° F., 1825° F. and 1850° F. for 45 minutes and water quenched. Each plate was cold rolled 90% to 0.082 inch thick, and cut into three pieces which were then aged 4 hours at respective temperatures of 750° F., 800° F. and 850° F. in argon.

TABLE 3

| | Heat C Wt % | Heat D Wt % | Heat E Wt % | Heat F Wt % | Heat G Wt % | Heat H Wt % |
|---|---|---|---|---|---|---|
| Be | 0.63 | 0.58 | 0.50 | 0.42 | 0.40 | 0.42 |
| Ni | 0.01 | 0.01 | 1.00 | 1.70 | 1.91 | 1.64 |
| Co | 2.50 | 2.62 | 1.00 | <0.01 | 0.005 | 0.05 |
| Fe | 0.04 | 0.05 | 0.03 | <0.01 | <0.01 | 0.06 |
| Si | 0.04 | 0.04 | 0.02 | 0.02 | <0.01 | 0.07 |
| Al | 0.02 | 0.02 | <0.01 | <0.01 | <0.01 | 0.03 |
| Sn | 0.006 | 0.012 | <0.003 | <0.005 | <0.005 | 0.01 |
| Zn | <0.01 | <0.01 | <0.01 | <0.01 | <0.01 | <0.01 |
| Cr | <0.005 | <0.005 | <0.005 | <0.005 | <0.005 | <0.005 |
| Pb | <0.003 | <0.003 | <0.003 | <0.003 | <0.003 | <0.003 |
| P | <0.005 | <0.005 | <0.005 | 0.001 | <0.005 | <0.005 |
| Cu | Bal. | Bal. | Bal. | Bal. | Bal. | Bal. |

Standard tensile specimens were prepared from the aged strip. All materials were tested in the longitudinal direction and certain materials were also tested in the transverse direction. Electrical conductivity was measured at room temperature.

Results from Heat F are given in Table 4.

EXAMPLE 3

Material from Heat G was processed as a commercial weight coil by hot rolling, annealing, surface conditioning and cold rolling to an intermediate thickness of 0.060 inch. The cold rolled 0.060 inch strip at a width of 7.5 inches was strand solution annealed at 1800° F. The annealed strip was then finish rolled to about 0.0083 inches, a reduction of approximately 90%. Tensile specimens were cut from the strip in both longitudinal and transverse directions and aged in argon at 700° F., 750° F., 800° F. and 850° F. One set was aged for four hours and one set was aged for 8 hours. Tensile properties, formability and conductivity were obtained. Formability was determined on the thin strip specimens by bending 90° around punches having successively smaller radii until cracking occurred on the tensile surface of the bend. The minimum bend radius, taken as the smallest radius which can be used without cracking, was expressed in multiples of strip thickness.

Results from Heat G are set forth in Table 5, in which mechanical properties reported are based on the average of duplicate tests.

EXAMPLE 4

Materials from Heats C, D, E and H having a variety of compositions were processed similar to Heat G in Example 3. Strip materials at a ready-to-finish gage ranging from 0.020–0.060 in. were solution annealed at 1800° F. The annealed strip was finish rolled to effect a reduction of approximately 90%. Specimens were sectioned in the longitudinal orientation and aged for four hours at 750° F. in argon. Tensile properties and electrical conductivity were obtained at room temperature. The results are set forth in Table 6.

TABLE 4

Mechanical and Electrical Properties of (Heat F.) Strip, 0.082" Thick Solution Annealed, Cold Rolled 90% and Aged Four Hours

| Annealing Temp. °F. | Aging Temp. °F. | Specimen Orientation | Tensile Strength ksi | 0.2% Yield Strength ksi | Percent Elongation in 1 inch | Rockwell C Hardness | Electrical Conductivity % IACS |
|---|---|---|---|---|---|---|---|
| 1750 | 850 | Long. | 111.7 | 100.1 | 12.9 | 21.7 | 60.5 |
| | | Long. | 113.5 | 102.1 | 14.6 | N.D. | N.D. |
| | | Trans. | 114.5 | 105.7 | 13.9 | 22.1 | 61.2 |
| | | Trans. | 113.1 | 104.6 | 15.0 | N.D. | N.D. |
| 1800 | 850 | Long. | 124.2 | 109.0 | 11.4 | 25.2 | 57.9 |
| | | Long. | 126.9 | 112.5 | 10.7 | N.D. | N.D. |
| | | Trans. | 130.9 | 117.6 | 11.6 | 28.0 | 58.0 |
| | | Trans. | 131.7 | 121.9 | 10.4 | N.D. | N.D. |
| 1825 | 850 | Long. | 126.0 | 110.6 | 12.7 | 27.1 | 58.0 |
| | | Long. | 124.7 | 110.0 | 11.5 | N.D. | N.D. |
| | | Trans. | 130.5 | 118.5 | 11.5 | 28.3 | 59.0 |
| | | Trans. | 131.5 | 119.6 | 9.6 | N.D. | N.D. |
| 1850 | 850 | Long. | 126.6 | 113.5 | 11.9 | 27.0 | 57.2 |
| | | Long. | 127.8 | 115.1 | 9.9 | N.D. | N.D. |
| | | Trans. | 133.1 | 120.8 | 5.1 | 28.3 | 58.0 |
| | | Trans. | 133.2 | 120.6 | 6.6 | N.D. | N.D. |
| 1750 | 800 | Long. | 132.6 | 121.7 | 11.2 | 28.0 | 55.2 |
| | | Long. | 132.6 | 122.6 | 11.6 | N.D. | 55.5 |
| 1800 | 800 | Long. | 143.0 | 133.0 | 8.4 | 32.2 | 51.8 |
| | | Long. | 143.6 | 134.0 | 7.9 | N.D. | 52.5 |
| 1825 | 800 | Long. | 144.9 | 137.8 | 7.6 | 33.2 | 50.5 |
| | | Long. | 143.8 | 133.0 | 9.6 | N.D. | 51.2 |
| 1850 | 800 | Long. | 145.0 | 136.0 | 7.7 | 33.4 | 51.0 |
| | | Long. | 144.6 | 134.8 | 7.9 | N.D. | 51.0 |
| 1825 | 750 | Long. | 149.0 | 139.7 | 7.8 | 33.5 | 50.0 |
| | | Long. | 149.8 | 140.7 | 8.8 | N.D. | N.D. |
| | | Trans. | 154.7 | 149.1 | 10.0 | 34.1 | 49.5 |
| | | Trans. | 154.8 | 149.1 | 8.8 | N.D. | N.D. |

TABLE 5

AGING RESPONSE STUDIES OF 0.0083" HEAT G STRIP

| Heat Treatment | Orientation | Tensile Strength ksi | 0.2% Offset Yield Strength ksi | Percent Elongation in 1 inch | Diamond Pyramid Hardness | Electrical Conductivity % IACS | 90° Bend Formability R/t |
|---|---|---|---|---|---|---|---|
| 4 hr @ 700 F. | Long. | 142.2 | 134.5 | 6.8 | 294 | 46.5 | 2.5 |
| | Trans. | 145.0 | 137.6 | 11.2 | 294 | 46.3 | 11.2 |
| 8 hr @ 700 F. | Long. | 142.0 | 136.1 | 6.6 | 299 | 47.8 | 2.5 |
| | Trans. | 144.0 | 140.1 | 11.0 | 296 | 47.7 | 11.2 |
| 4 hr @ 750 F. | Long. | 145.6 | 136.8 | 7.1 | 305 | 52.4 | 2.5 |
| | Trans. | 146.9 | 142.7 | 10.9 | 302 | 51.6 | 23.4 |
| 8 hr @ 750 F. | Long. | 139.8 | 128.0 | 7.6 | 296 | 58.2 | 1.2 |
| | Trans. | 142.7 | 135.0 | 11.5 | 293 | 56.0 | 9.4 |
| 4 hr @ 800 F. | Long. | 144.5 | 135.9 | 6.8 | 301 | 52.4 | 2.5 |
| | Trans. | 147.6 | 141.9 | 10.8 | 301 | 50.6 | 23.4 |
| 8 hr @ 800 F. | Long. | 138.9 | 133.1 | 7.7 | 294 | 55.5 | 1.2 |
| | Trans. | 144.0 | 140.0 | 11.3 | 293 | 55.1 | 9.4 |
| 4 hr @ 850 F. | Long. | 122.4 | 113.6 | 9.1 | 251 | 62.6 | 0.6 |
| | Trans. | 125.7 | 118.6 | 9.6 | 251 | 62.6 | 3.7 |
| 8 hr @ 850 F. | Long. | 117.5 | 102.7 | 8.1 | 244 | 66.1 | 1.2 |
| | Trans. | 120.0 | 113.0 | 8.7 | 240 | 65.6 | 2.5 |

TABLE 6

Mechanical and Electrical Properties (Longitudinal Orientation) of Beryllium Copper Strip, Solution Annealed at 1800 F., Cold Rolled 90% and Aged at 750 F. for 4 Hours

| Alloy/Composition (wt %) | Ultimate Tensile Strength ksi | 0.2% Yield Strength ksi | Elongation (Percent in 1 in.) | Electrical Conductivity % IACS |
|---|---|---|---|---|
| Heat C | 120.3 | 118.2 | 1.7 | 46.7 |
| (0.63 Be, 2.50 Co, | 116.6 | 113.0 | 3.3 | 46.7 |
| 0.01 Ni, bal. Cu) | | | | |
| Heat D | 129.9 | 124.6 | 6.3 | 46.0 |
| (0.58 Be, 2.62 Co, | 113.8 | 107.2 | 6.1 | 46.0 |
| 0.01 Ni, bal. Cu) | | | | |
| Heat E | 155.4 | 150.1 | 5.0 | 46.5 |
| (0.5 Be, 1.00 Co, | 153.9 | 148.5 | 3.5 | 46.5 |
| 1.00 Ni, bal. Cu) | 154.1 | 146.0 | 4.5 | 46.0 |
| | 152.9 | 147.1 | 5.5 | 47.0 |
| Heat H | 153.4 | 145.1 | 5.6 | 41.2 |
| (0.42 Be, 1.64 Ni, | 144.7 | 137.8 | 5.8 | 41.2 |
| 0.05 Co, bal. Cu) | | | | |

The data of Table 6 show that beryllium-copper alloys-containing nickel in excess of about 1.0 wt% experience an increase in as-annealed hardness with increasing annealing temperature, whereas beryllium copper alloys containing cobalt with only trace amounts of nickel continue to soften with increasing annealing temperature. The reason for this anomalous hardness increase is apparent from Table 2. At annealing temperatures near 1800° F., the nickel-containing beryllium coppers of Table 2 (i.e., Heats A, B and E) form a nickel-rich precipitate which is distinct from both the primary beryllide phase and the principal hardening phase as illustrated in FIGS. 1 and 2. The cobalt-containing beryllium coppers of Table 2 (i.e., Heats C and D) do not form such precipitates at the higher annealing temperature. These nickel-rich precipitates are believed to contribute to the enhanced mechanical and physical properties of the alloys processed per this invention through: (a) strengthening of the matrix by dispersion hardening, (b) ductility improvement through inhibition of grain growth at the high annealing temperature and (c) improvement in conductivity through depletion of alloying elements in solid solution.

An additional reason for the improved properties provided in accordance with the invention has to do with the high volume fraction of coherent principal hardening precipitates which forms on aging of material previously subjected to the high solution annealing temperature and substantial cold work. The high solution annealing treatment dissolves more beryllium and nickel plus cobalt in the copper matrix, thereby providing more material available to precipitate on aging. The heavy cold work provides a deformation texture contributing to the high strength.

Inspection of the data in Tables 4, 5 and 6 indicates that the best combinations of strength and ductility resulted from the combination of (a) presence of nickel over about 1 wt%, (b) annealing temperatures of at least 1800° F. and (c) aging at 750° F. Property combinations including 140,000 psi yield strength, 10% elongation and a conductivity near 50% IACS were obtained. Conductivity and formability were improved by the 8-hour aging time. It is to be appreciated that the alloys tested in Tables 4 and 5 contained less than 0.01% each of iron, cobalt and aluminum and that this low impurity level contributes significantly to electrical conductivity. Nevertheless, strip material of comparable composition conventionally processed by cold rolling even as much as 37% to full hard temper after age hardening to a yield strength of approximately 140,000 psi would be found to have an elongation not exceeding 2%, with poorer formability and lower conductivity. Conversely, material of similar composition subjected to overaging to achieve 60% IACS minimum conductivity would exhibit less than 75,000 psi yield strength.

The data of Table 6 clearly show that cobalt-containing beryllium coppers with only trace amounts of nickel do not respond as favorably to the processing of this invention as do their nickel-containing counterparts.

It is to be further appreciated that the properties reported in Tables 4, 5 and 6 are dependent upon the beryllium and nickel contents of the example heats. Different chemistries within the ranges defined will yield different property levels, but it is believed that, when processed according to the teachings of the invention, these compositions will yield superior properties compared to the same alloys conventionally processed. Once formed the nickel-rich precipitates described above appear to remain stable and to resist resolution on subsequent reannealing suggesting that additional advantages may accrue from annealing at high temperatures at various process points.

Inspection of the data in Tables 4, 5 and 6 demonstrates that alloys processed according to this invention will, on a graph of ultimate tensile strength (UTS) versus elongation, usually lie along a line connecting the points defined by 150 ksi UTS at 3.5% elongation and 120 ksi UTS at 15% elongation, but will at least lie along or above a line connecting the points defined by 132 ksi UTS at 5.0% elongation, and 120 ksi UTS at 9.0% elongation. Furthermore, alloys processed according to this invention will, on a graph of ultimate tensile strength (UTS) versus electrical conductivity, usually lie along a line connecting the points defined by 152 ksi UTS at an electrical conductivity of 47% IACS and 115 ksi UTS at 66% IACS, but will at least lie along or above a line connecting the points defined by 142 ksi UTS at an electrical conductivity of 42% IACS and 112 ksi UTS at an electrical conductivity of 61% IACS.

What is claimed is:

1. A thermomechanical process for obtaining improved combinations of properties in beryllium copper alloys essentially of at least about 1.0 wt. % to about 3.5 wt. % nickel and cobalt in the aggregate, with at least about 1 wt. % nickel; about 0.2 wt. % to about 0.7 wt. % beryllium; up to about 1.0 wt. % zirconium; up to about 0.005 wt. % lead; up to 0.1 wt. % magnesium; up to about 1.5 wt. % silver; and up to about 0.5 wt. % incidental impurities including lead; and the balance essentially copper; which comprises the steps of solution treating the alloy at a temperature within about 90% of the incipient melting temperature thereof expressed in degrees Fahrenheit, to effect precipitation of a fine dispersion of a nickel-rich phase, cold working the solution treated alloy to reduce the section thickness thereof at least about 60% and thereafter aging the cold worked alloy at a temperature of about 600° F. to about 900° F. to produce in said alloy in the condition resulting from said aging an improved combination of properties including strength, ductility and electrical conductivity; which on a graph of ultimate tensile strength versus elongation lie along or above a line connecting the points defined by 150 ksi ultimate tensile strength at 3.5% elongation and 120 ksi ultimate tensile strength at 15% elongation.

2. A process in accordance with claim 1 which produces in said beryllium copper alloy properties, which on a graph of ultimate tensile strength versus electrical conductivity, lie along or above a line connecting the points defined by 142 ksi ultimate tensile strength at an electrical conductivity of 42% IACS and 112 ksi ultimate tensile strength at an electrical conductivity of 61% IACS.

3. A process in accordance with claim 1 wherein said beryllium copper alloy contains about 0.4 wt% to about 0.7 wt% beryllium.

4. A process in accordance with claim 1 wherein said beryllium copper alloy contains at least about 1.4 wt% nickel.

5. A process in accordance with claim 1 wherein said beryllium copper alloy contains about 1.8 wt% to about 2.2 wt% nickel.

6. A process in accordance with claim 2 wherein said beryllium copper alloy contains about 1.8 wt% to about 2.2 wt% nickel.

7. A process in accordance with claim 1 wherein said solution treatment is conducted at a temperature within about 92% of the incipient melting temperature for the alloy expressed in degrees Fahrenheit.

8. A process in accordance with claim 1 wherein said solution treatment is conducted at a temperature within about 95% of the incipient melting temperature for the alloy expressed in degrees Fahrenheit.

9. A process in accordance with claim 1 wherein said alloy is cold worked to reduce the section thickness thereof at least about 75%.

10. A process in accordance with claim 1 wherein said alloy is cold worked to reduce the section thickness thereof at least about 80%.

11. A process in accordance with claim 1 wherein said solution treatment is conducted when said alloy is at a ready-to-finish gage.

12. Rod, bar, tube, plate, strip and wire made of an age hardenable alloy consisting essentially of at least about 1.0 wt% to about 3.5 wt% nickel and cobalt in the aggregate, with at least about 0.2 wt% to about 0.7 wt% beryllium; up to about 1.0 wt% zirconium; up to about 0.005 wt% lead; up to 0.1 wt% magnesium; up to about 1.5 wt% silver; and up to about 0.5 wt% incidental impurities including lead; and the balance essentially copper; having (a) a textured grain orientation, (b) a yield strength higher in the transverse direction than in the longitudinal direction, (c) a microstructure including an optically resolvable nickel-rich phase distinct from the primary beryllide and the principal hardening phases, and (d) an improved combination of properties including strength, ductility and electrical conductivity; which on a graph of ultimate tensile strength versus elongation will lie along or above a line connecting the points defined by 149 ksi ultimate tensile strength at 2% elongation and 100 ksi ultimate tensile strength at 15% elongation.

13. A process in accordance with claim 1 wherein said solution treatment is conducted at a temperature of at least about 1800° F.

14. A process in accordance with claim 1 wherein said alloy is cold worked to reduce the section thickness thereof at least about 90%.

* * * * *